US011119433B2

(12) United States Patent
Ito

(10) Patent No.: US 11,119,433 B2
(45) Date of Patent: Sep. 14, 2021

(54) IMAGE FORMING APPARATUS

(71) Applicant: CANON KABUSHIKI KAISHA, Tokyo (JP)

(72) Inventor: Takahiro Ito, Noda (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/862,035

(22) Filed: Apr. 29, 2020

(65) Prior Publication Data

US 2020/0356040 A1 Nov. 12, 2020

(30) Foreign Application Priority Data

May 11, 2019 (JP) ..... JP2019-090270

(51) Int. Cl.

| | |
|---|---|
| ***G03G 15/00*** | (2006.01) |
| ***G03G 21/16*** | (2006.01) |
| ***B65H 29/56*** | (2006.01) |
| ***G03G 21/00*** | (2006.01) |
| ***G03G 15/02*** | (2006.01) |
| ***G03G 15/01*** | (2006.01) |
| ***G03G 15/16*** | (2006.01) |

(52) U.S. Cl.

CPC ..... *G03G 15/6532* (2013.01); *B65H 29/56* (2013.01); *G03G 15/0184* (2013.01); *G03G 15/0216* (2013.01); *G03G 15/1605* (2013.01); *G03G 15/657* (2013.01); *G03G 15/70* (2013.01); *G03G 21/007* (2013.01); *G03G 21/169* (2013.01); *G03G 21/1671* (2013.01); *G03G 2215/004* (2013.01); *G03G 2215/00413* (2013.01); *G03G 2215/00548* (2013.01); *G03G 2221/0005* (2013.01); *G03G 2221/1609* (2013.01); *G03G 2221/1618* (2013.01)

(58) Field of Classification Search

CPC ..... G03G 15/6532; G03G 15/0184; G03G 15/0216; G03G 15/1605; G03G 15/657; G03G 15/70; G03G 21/007; G03G 21/1671; G03G 21/169; G03G 2215/004; G03G 2215/00413; G03G 2215/00548; G03G 2221/0005; G03G 2221/1609; G03G 2221/1618; B65H 29/56

See application file for complete search history.

(56) References Cited

U.S. PATENT DOCUMENTS

| | | | | |
|---|---|---|---|---|
| 3,578,859 A * | 5/1971 | Stillings | ..... | G03G 15/6532 271/308 |
| 2009/0285599 A1* | 11/2009 | Isokawa | ..... | G03G 15/6532 399/111 |
| 2015/0030352 A1* | 1/2015 | Hayashi | ..... | G03G 15/6532 399/128 |

FOREIGN PATENT DOCUMENTS

JP S62157074 A 7/1987

* cited by examiner

*Primary Examiner* — Joseph S Wong

(74) *Attorney, Agent, or Firm* — Canon U.S.A., Inc. IP Division

(57) ABSTRACT

A protruding portion protruding in a rotation axis direction of an image bearing member is provided at a position between the tip of a separation claw and an apex of the separation claw, when the apex of the separation claw is disposed at a position farthest from the surface of the image bearing member in a direction perpendicular to a straight line connecting the tip and the rotation center of a shaft portion of the separation claw.

8 Claims, 8 Drawing Sheets

IMAGE FORMING APPARATUS

BACKGROUND

Field of the Disclosure

The present disclosure relates to image forming apparatuses, such as a copying machine, a printer, a facsimile machine, and a multifunction peripheral including these functions.

Description of the Related Art

Image forming apparatuses, such as an electrophotographic copying machine, printer, or facsimile machine, have been available which have a structure in which a toner image formed on an image bearing member, such as a photosensitive member and an intermediate transfer belt, is transferred onto a sheet and the sheet onto which the toner image is transferred is heated and pressurized by a fixing unit, to form an image on the sheet.

In such image forming apparatuses, a cleaning unit for cleaning the surface of the image bearing member is provided on a downstream side of a transfer position at which a toner image is transferred onto a sheet in a rotation direction of the image bearing member.

Of the toner forming the toner image formed on the surface of the image bearing member, residual toner which has not been transferred onto the sheet is collected by the cleaning unit along with the rotation of the image bearing member.

In such a structure, the sheet that passes through the transfer position of the image bearing member can be electrostatically attracted and stuck to the surface of the image bearing member and then can be wound around the image bearing member. If the image bearing member is continuously rotated in the state where the sheet is wound around the image bearing member in this way, the sheet wound around the image bearing member enters the cleaning unit, which can cause a failure in the cleaning unit, or a scratch on the surface of the image bearing member.

In this regard, Japanese Patent Application Laid-Open No. 62-157074 discusses a structure in which a separation claw for separating a sheet wound around an image bearing member so as to remove the sheet is located on a downstream side of a transfer position in a rotation direction of the image bearing member.

The separation claw is configured to come into contact with the rotating image bearing member, and has a sharp leading edge that comes into contact with the image bearing member such that a sheet which is attracted and stuck to the surface of the image bearing member can be separated from the image bearing member.

However, even in the structure including the separation claw having a sharp leading edge as discussed in Japanese Patent Application Laid-Open No. 62-157074, a strong force of attraction to the image bearing member at a leading edge of the sheet in a conveyance direction thereof may allow the leading edge of the sheet to pass through the separation claw, thus failing to separate the sheet from the image bearing member, in some cases.

In a case where the sheet that cannot be separated by the separation claw is a pre-punched sheet, the force of attraction to the image bearing member in the vicinity of a hole of the sheet is often weaker than that at a leading edge of the sheet, due to deformation of fiber of the sheet caused during a punching process. In such a case, the separation claw can get into the hole formed on the sheet after the leading edge of the sheet has passed through the separation claw.

In this case, if the separation claw deeply gets into the hole to such a position that the separation claw cannot be pulled out from the hole, the separation claw can be damaged due to excessive rotation when the sheet is pulled out by a user.

SUMMARY

According to an aspect of the present disclosure, an image forming apparatus includes an image bearing member configured to bear a toner image and transfer the toner image onto a sheet at a transfer position, a cleaning mechanism configured to clean toner on the image bearing member, and a separation mechanism disposed between the transfer position and the cleaning mechanism in a rotation direction of the image bearing member, the separation mechanism including a separation claw configured to come into contact with the image bearing member and separate the sheet, and a support base that rotatably supports the separation claw. The separation claw extends towards the image bearing member from the support base, and includes a leading edge that comes into contact with a surface of the image bearing member and a protruding portion protruding in a rotation axis direction of the image bearing member, and an apex of the separation claw is disposed at a position farthest from the surface of the image bearing member in a direction perpendicular to a straight line connecting a tip portion of the leading edge and a rotation center of a shaft portion of the separation claw engaged with the support base. The protruding portion is disposed at a position between the tip portion and the apex.

Further features of the present disclosure will become apparent from the following description of exemplary embodiments with reference to the attached drawings.

DESCRIPTION OF THE EMBODIMENTS

Modes for carrying out the present disclosure will be described below with reference to the accompanying drawings. The dimensions, materials, shapes, relative arrangements, and the like of the components described in the following exemplary embodiments are not intended to limit the scope of the present disclosure unless specifically noted.

Figure 1:
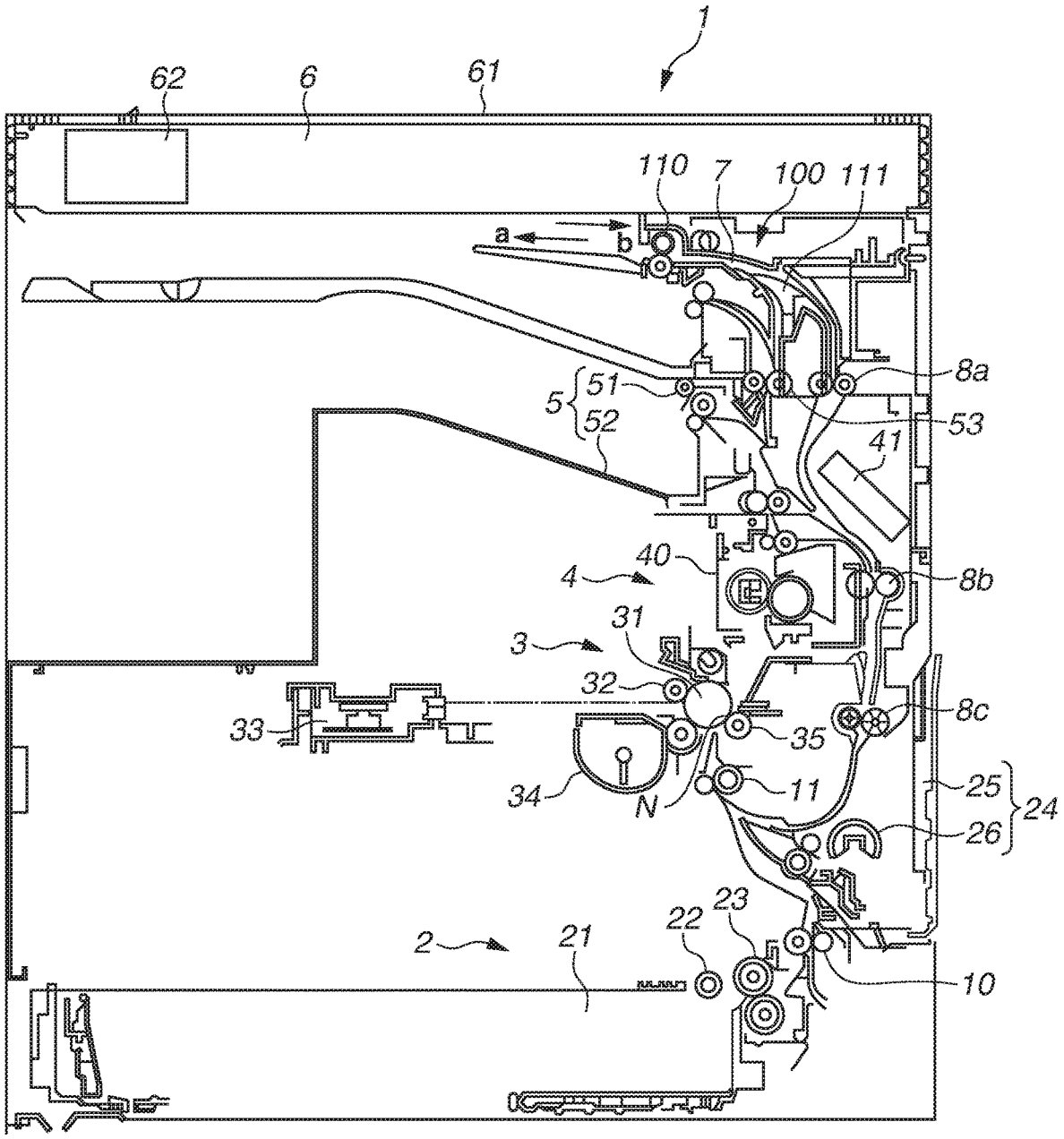
FIG. 1 is a schematic sectional view illustrating an image forming apparatus according to an exemplary embodiment.

A first exemplary embodiment of the present disclosure will be described below. FIG. 1 is a schematic sectional view schematically illustrating an overall structure of an image forming apparatus 1 according to the present exemplary embodiment.

As illustrated in FIG. 1, the image forming apparatus 1 according to the first exemplary embodiment includes a feeding unit 2, an image forming unit 3, a fixing section 4, a discharge unit 5, and an image reading unit 6. The feeding unit 2 feeds a sheet to the image forming unit 3. The image forming unit 3 forms a toner image on the sheet. The fixing section 4 fixes the toner image formed by the image forming unit 3 onto the sheet. The discharge unit 5 discharges the sheet onto which the toner image is fixed. The image reading unit 6 is capable of reading an image on a document.

The feeding unit 2 is provided a vertically lower part of the image forming apparatus 1, and includes a stacking tray 21 on which sheets are stacked, a pick-up roller 22 that picks up the sheets stacked on the stacking tray 21, and a separating/feeding portion 23 that separates the picked up sheets one by one and feeds the separated sheet. In the present exemplary embodiment, the feeding unit 2 includes a manual feeding unit 24 that can feed sheets placed by a user from a side of the image forming apparatus 1. The manual feeding unit 24 includes a manual feed tray 25 on which sheets are stacked, and a manual separating/feeding portion 26 that separates the sheets stacked on the manual feed tray 25 and feeds the separated sheet.

The image forming unit 3 is provided vertically above the feeding unit 2, and includes a photosensitive member 31 on which a toner image is formed, a charge roller 32 that uniformly charges the surface of the photosensitive member 31, an exposure device 33 that applies laser light to form an electrostatic latent image on the photosensitive member 31, a development device 34 that visualizes the electrostatic latent image on the photosensitive member 31 as a toner image, and a transfer roller 35. A transfer nip portion N is formed between the photosensitive member 31 and the transfer roller 35.

The fixing section 4 is provided on a downstream side of the image forming unit 3 in a sheet conveyance direction.

The discharge unit 5 is provided on the downstream side of the fixing section 4, and includes a discharge roller pair 51 that discharges sheets from the inside of an apparatus body of the image forming apparatus 1, and a discharge tray 52 on which the discharged sheets are stacked. The image reading unit 6 is provided at an upper part of the apparatus body of the image forming apparatus 1, and includes a document placement portion 61 on which documents are placed, and a scanner 62. The scanner 62 scans image information about a document that is placed on the document placement portion 61 and is pressed against the document placement portion 61 by a pressing plate (not illustrated).

In the image forming apparatus 1 having such a structure, when an image formation job is started, the exposure device 33 irradiates the surface of the photosensitive member 31 with laser light based on the image information transmitted from an external apparatus, such as a personal computer (not illustrated), or the image reading unit 6. Thus, the surface of the photosensitive member 31 that is uniformly charged to a predetermined polarity potential by the charge roller 32 is exposed to light, and the electrostatic latent image is formed on the surface of the photosensitive member 31. The electrostatic latent image formed on the photosensitive member 31 is developed with toner by the development device 34.

In parallel with the operation of forming the toner image on the photosensitive member 31 as described above, the sheet separated one by one and fed from the feeding unit 2 are conveyed to a registration roller pair 11, which is provided on the downstream side in the sheet conveyance direction, by a conveyance roller pair 10, and skew of each sheet is corrected by the registration roller pair 11. After that, the sheet, the skew of which has been corrected, is conveyed to the transfer nip portion N at a predetermined timing, and the toner image is transferred onto the sheet by the transfer roller 35.

The sheet onto which the toner image is transferred is conveyed to the fixing section 4 from the transfer nip portion N, and the sheet is heated and pressurized by a fixing unit 40 to thereby fuse toner and fix the toner as an image. After that, the sheet onto which the image is fixed is discharged onto the discharge tray 52 by the discharge roller pair 51, and thus the image formation job ends.

Next, a process for forming an image on both sides of a sheet in the image formation job which is performed by the image forming apparatus 1 will be described.

In the process of forming an image on a first surface of a sheet, the sheet is fed from the feeding unit 2 described above and is then conveyed to the conveyance roller pair 10, the registration roller pair 11, and the transfer nip portion N in this order, and the image is transferred onto the first surface of the sheet. After that, a process similar to the process in which the sheet is conveyed to the fixing section 4 and toner is fused and fixed as an image as described above is performed.

The sheet having the first surface onto which the image is transferred is conveyed to a reverse path 7 of a sheet reversing device 100 by an intermediate discharge roller pair 53. A leading edge of the sheet conveyed to a reverse roller pair 110 is then discharged in an in-body sheet discharge direction (direction indicated by an arrow "a" in FIG. 1). After a trailing edge of the sheet nipped by the reverse roller pair 110 passes through a conveyance path switching flapper 111, the rotation of the reverse roller pair 110 is reversed.

Accordingly, the sheet is pulled into the apparatus body of the image forming apparatus 1 again (in a direction indicated by an arrow "b" in FIG. 1) by the reverse roller pair 110 which is rotated reversely, and the sheet is conveyed to the registration roller pair 11 and the transfer nip portion N again by first, second, and third two-sided conveyance roller pairs 8*a*, 8*b*, and 8*c*. In this case, a second surface of the sheet faces the photosensitive member 31 so that the image can be transferred onto the second surface by the transfer nip portion N. The image is then fixed onto the sheet by the fixing section 4 and the sheet is discharged onto the discharge tray 52 by the discharge roller pair 51. Thus, the image formation job for forming an image on the both sides of the sheet ends.

Figure 2:
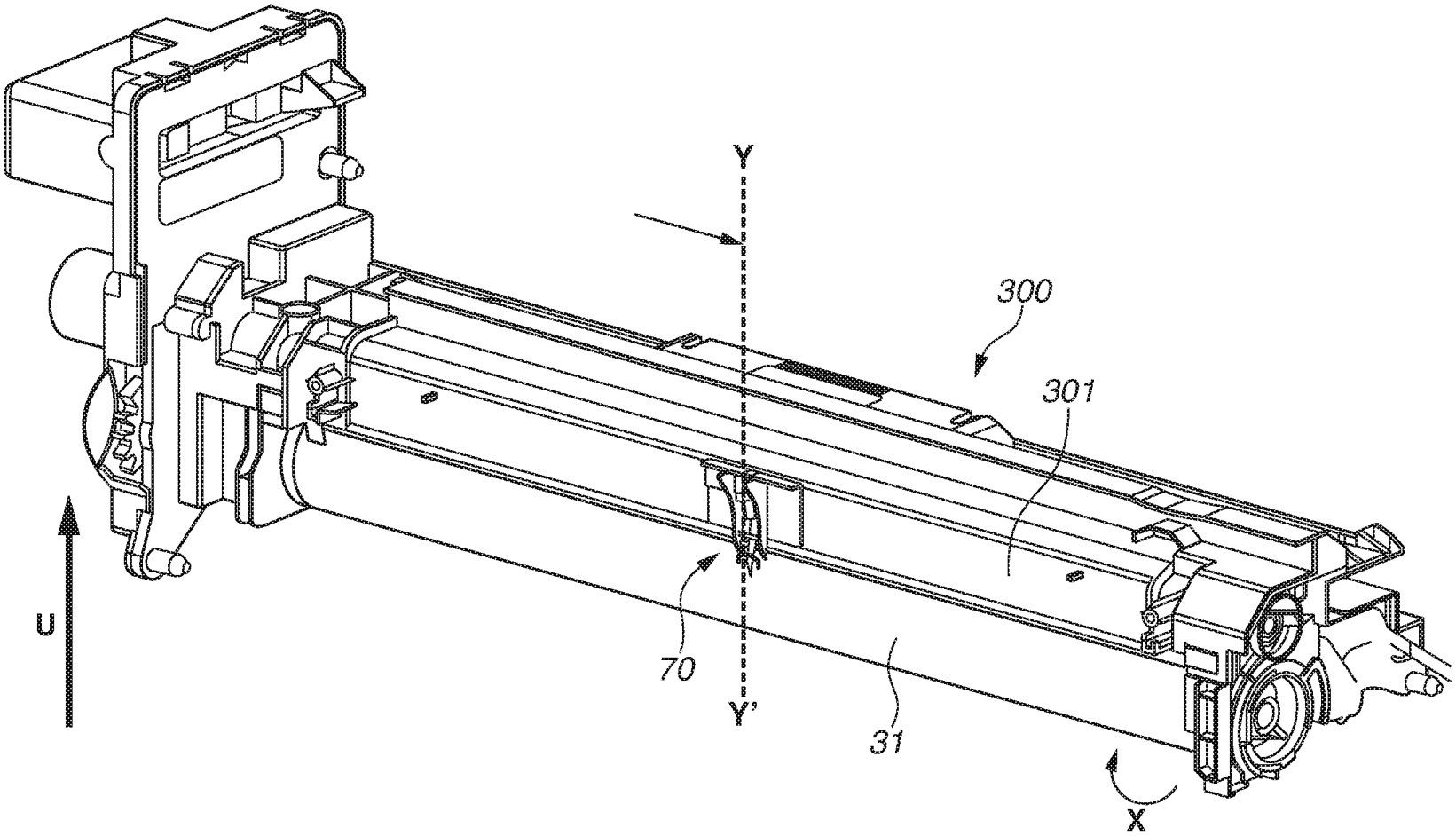
FIG. 2 is a perspective view illustrating a photosensitive member cartridge according to an exemplary embodiment.
Figure 3B:
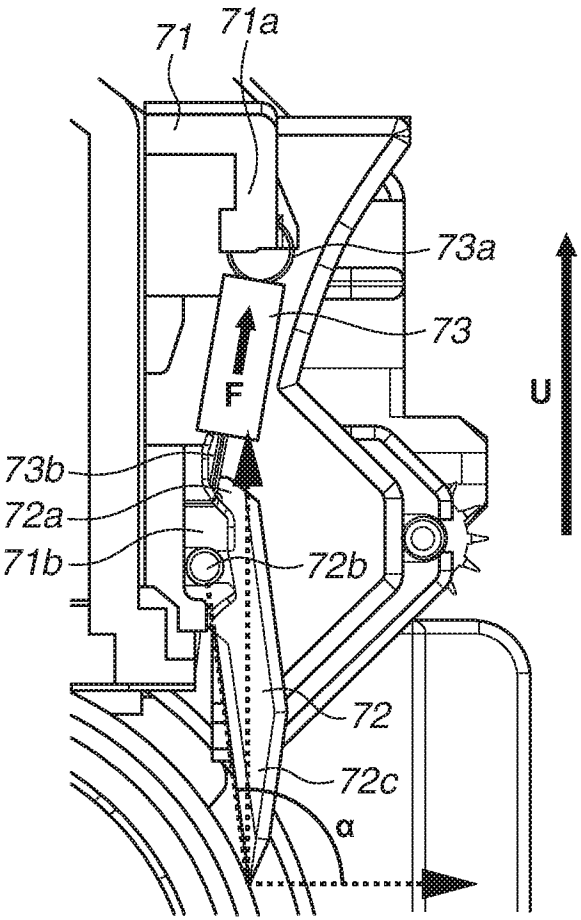
FIGS. 3A and 3B are sectional views each illustrating the photosensitive member cartridge according to an exemplary embodiment.
Figure 3A:
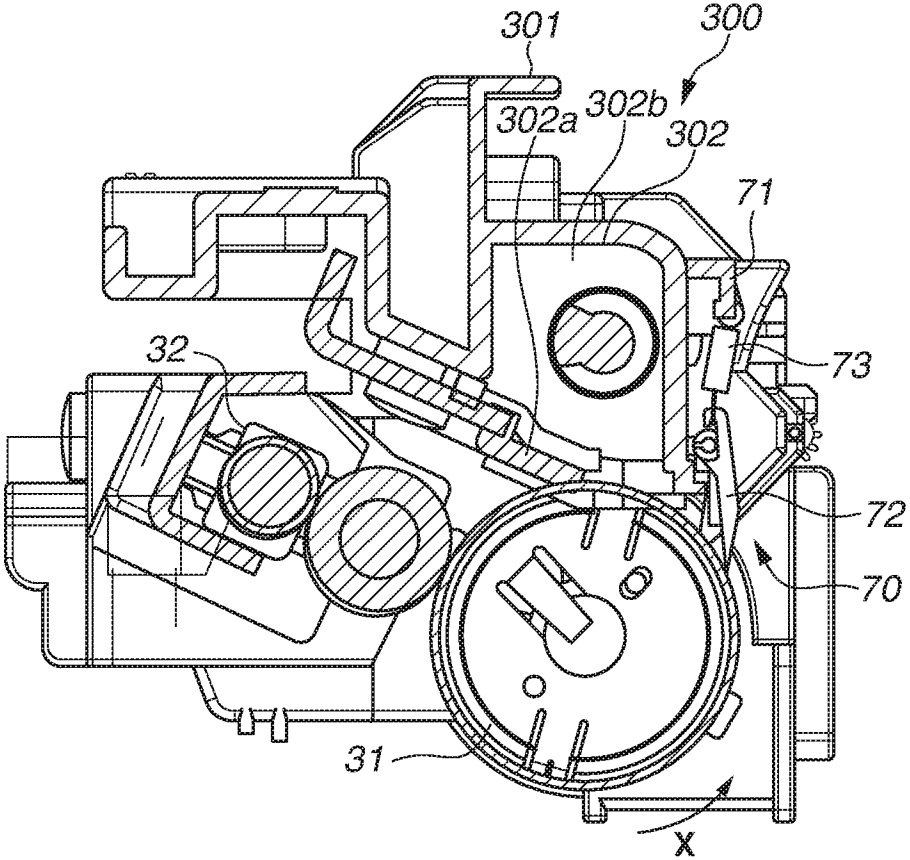
Figure 4B:
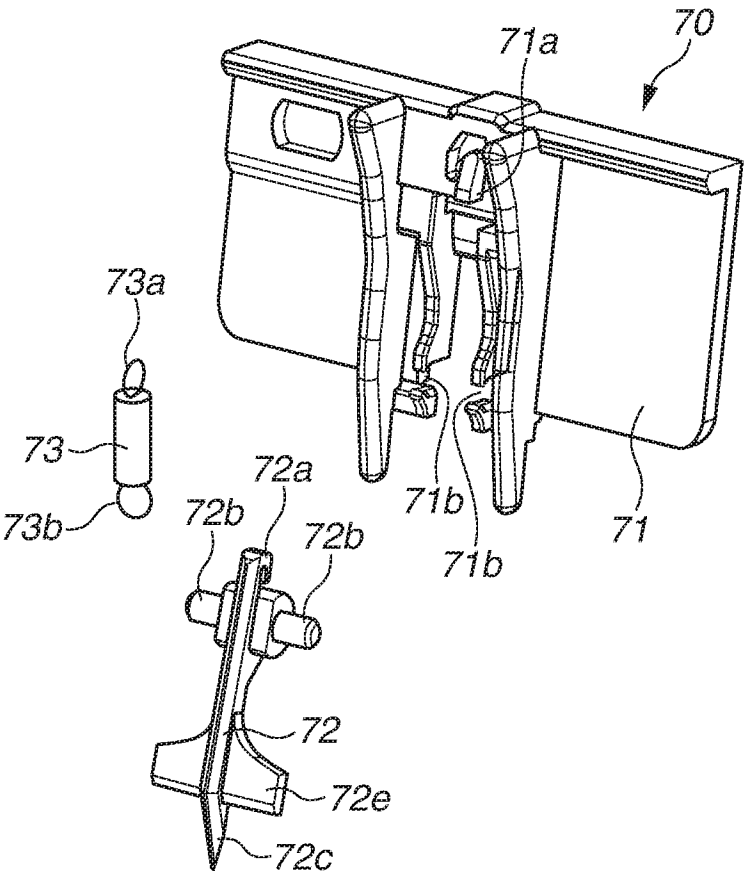
FIGS. 4A and 4B are enlarged perspective views each illustrating a separation mechanism according to the first exemplary embodiment.
Figure 4A:
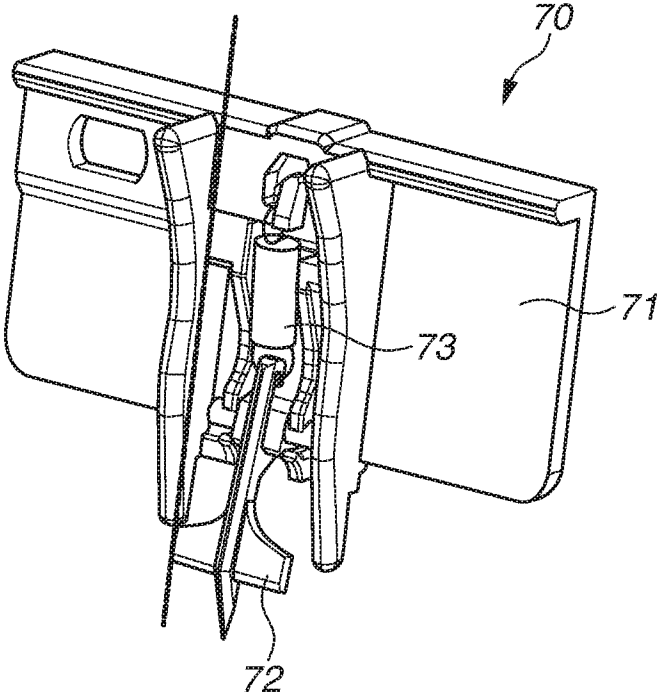
Figure 5A:
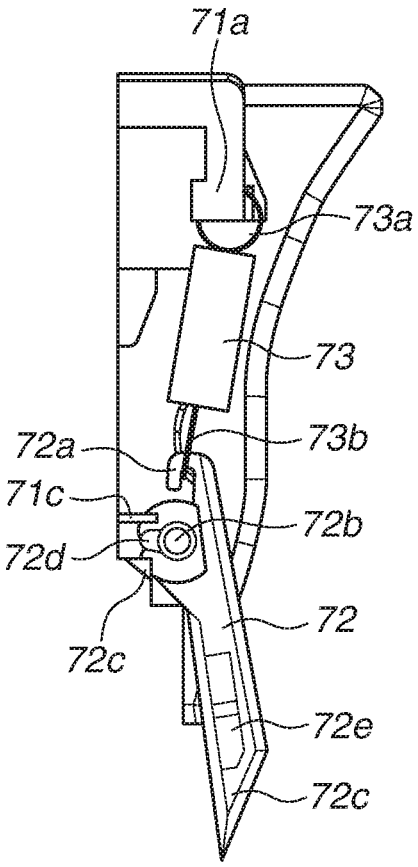
FIGS. 5A and 5B are sectional views each illustrating a rotating state according to the first exemplary embodiment.
Figure 5B:
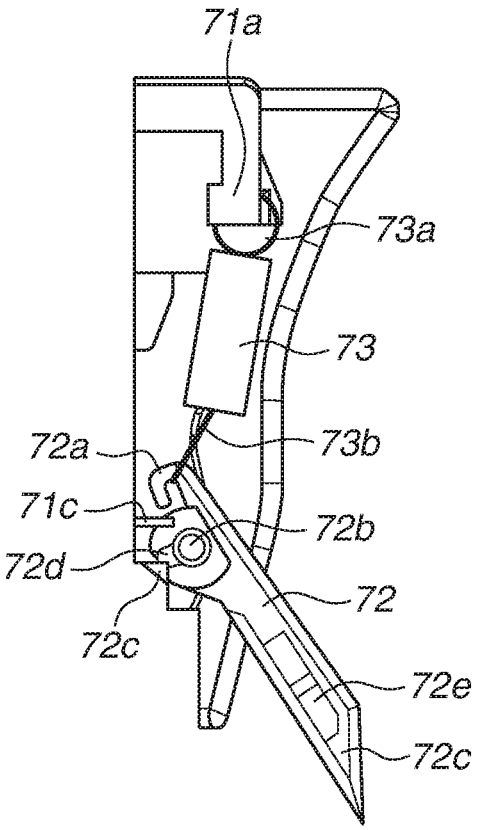

Next, a description will be provided of the structure of the photosensitive member 31 according to the present exemplary embodiment and the structure of a separation mechanism 70 for removing and separating a sheet attached to the photosensitive member 31. FIG. 2 is a perspective view illustrating a photosensitive member cartridge 36. FIG. 3A is a sectional view illustrating the overall structure of the photosensitive member cartridge 36. FIG. 3B is an enlarged sectional view illustrating the vicinity of the separation mechanism 70. FIG. 4A is an enlarged perspective view of the separation mechanism 70 according to the first exemplary embodiment after assembly. FIG. 4B is an enlarged perspective view of the separation mechanism 70 before assembly. FIGS. 5A and 5B are sectional views each illustrating a rotating state of a separation claw 72.

In the present exemplary embodiment, the photosensitive member 31 is supported by a support portion 301 of a photosensitive member cartridge 300. The separation mechanism 70 is mounted on the support portion 301. The photosensitive member 31 is rotated in a direction indicated by an arrow X in FIG. 2. The conveyance direction of the sheet onto which the toner image formed on the photosensitive member 31 is transferred corresponds to a direction indicated by an arrow U in FIG. 2.

As illustrated in FIG. 2, in the present exemplary embodiment, a single separation mechanism 70 is provided at a central portion of the photosensitive member 31 in a rotation axis direction (main scanning direction) of the photosensitive member 31. Thus, by providing the separation mechanism 70 at the central portion in the rotation axis direction of the photosensitive member 31, the function of separating sheets of any size when the sheets are conveyed based on the central position can be achieved.

In the present exemplary embodiment, a single separation mechanism 70 is provided, but instead a plurality of separation mechanisms 70 may be provided in the rotation axis direction of the photosensitive member 31. In a case where sheets are conveyed based on an end position of the photosensitive member 31, the separation mechanism 70 may be provided at a position closer to the end of the photosensitive member 31 than the central portion thereof.

FIGS. 3A and 3B are sectional views each illustrating the photosensitive member cartridge 300 taken along a line Y-Y' illustrated in FIG. 2. As illustrated in FIG. 3A, the photosensitive member cartridge 300 includes a cleaning mechanism 302 that is provided on the downstream side of the transfer nip portion N when the transfer nip portion N is set as a base point in the rotation direction (direction indicated by the arrow X) of the photosensitive member 31.

The cleaning mechanism 302 includes a cleaning blade 302*a* and a collecting portion 302*b*. The cleaning blade 302*a* comes into contact with the surface of the photosensitive member 31 to scrape off and clean residual toner which has not been transferred onto the sheet at the transfer nip portion N and remains on the surface of the photosensitive member 31. A collecting portion 302*b* collects the toner scraped off by the cleaning blade 302*a*. Thus, the surface of the photosensitive member 31 can be charged by the charge roller 32 in a state where the surface of the photosensitive member 31 is cleaned by the cleaning mechanism 302.

In general, the sheet onto which the toner image is transferred at the transfer nip portion N passes through a conveyance path and is then conveyed to the fixing section 4. However, in some rare cases, the sheet can be electrostatically attracted and stuck to the surface of the photosensitive member 31. Thus, if the sheet is attracted and stuck to the surface of the photosensitive member 31, the sheet may be wound around the photosensitive member 31, or may enter the cleaning mechanism 302.

Accordingly, in the first exemplary embodiment, the separation mechanism 70 is provided to remove and separate the sheet sticking to the surface of the photosensitive member 31.

Here, the separation mechanism 70 is provided between the separation nip portion N and the cleaning mechanism 302 in the rotation direction of the photosensitive member 31. This structure makes it possible to separate the sheet from the photosensitive member 31 before the leading edge of the sheet reaches a contact point between the cleaning blade 302*a* of the cleaning mechanism 302 and the photosensitive member 31 even in a case where the sheet is attracted and stuck to the surface of the photosensitive member 31.

Next, the structure of the separation mechanism 70 will be described in detail with reference to FIGS. 3B, 4A, 4B, 5A, and 5B. The separation mechanism 70 according to the present exemplary embodiment includes a separation claw base 71, the separation claw 72, and a spring 73.

The separation claw base 71 includes a spring mounting portion 71*a*, to which a base mounting portion 73*a* of the spring 73 is mounted by engaging the spring mounting portion 71*a*, and shaft support portions 71*b*. The shaft support portions 71*b* rotatably support a rotating shaft 72*b* of the separation claw 72. The separation claw base 71 is an example of a support base.

The spring 73 includes the base mounting portion 73*a*, which is mounted to the spring mounting portion 71*a* of the separation claw base 71 by engaging with the spring mounting portion 71*a*, and a claw mounting portion 73*b* which is mounted to a spring mounting portion 72*a* of the separation claw 72 by engaging with the spring mounting portion 72*a*.

The separation claw 72 includes the spring mounting portion 72*a*, the rotating shaft 72*b*, a leading edge 72*c*, a stopper 72*d*, and a pair of side surface ribs 72*e* (described below). To the spring mounting portion 72*a*, the claw mounting portion 73*b* of the spring 73 described above is mounted by engaging with the spring mounting portion 72*a*. The rotating shaft 72*b* is rotatably supported by the shaft support portions 71*b* of the separation claw base 71. The leading edge 72*c* comes into contact with the photosensitive member 31 to separate the sheet sticking to the surface of the photosensitive member 31. The stopper 72*d* defines a rotation range of the separation claw 72.

As illustrated in FIGS. 5A and 5B, the stopper 72*d* of the separation claw 72 comes into contact with a rotation regulating portion 71*c* of the separation claw base 71, thus regulating the rotation range of the separation claw 72 with respect to the separation claw base 71. In the present exemplary embodiment, the stopper 72*d* and the rotation regulating portion 71*c* are provided so that the rotation area of the leading edge 72*c* falls within 41°.

In a state where the separation mechanism 70 is mounted on the photosensitive member cartridge 300, the leading edge 72*c* contacts the photosensitive member 31 in such a manner that an angle $\alpha$ formed by a straight line connecting the rotating shaft 72*b* and the leading edge 72*c* of the separation claw 72 and a perpendicular line (horizontal straight line in FIG. 3B) passing through the center of the photosensitive member 31 is 98°. The leading edge 72*c* is formed such that the shape of the most leading edge is a curved surface with a radius of 0.05 mm or less as viewed along the rotation axis direction of the photosensitive member 31.

The leading edge 72*c* is inclined with an acute angle with respect to a tangent to the photosensitive member 31 at the contact point of the photosensitive member 31. Thus, the leading edge of the sheet attracted and stuck to the surface of the photosensitive member 31 climbs over the contact point of the separation claw 72 along with the rotation of the photosensitive member 31, so that the sheet can be easily removed from the photosensitive member 31.

The spring 73 is urged in a direction indicated by an arrow F in FIG. 3B, and a force acts in a direction in which the separation claw 72 is pulled from the separation claw base 71. Here, the rotating shaft 72*b* of the separation claw 72 is located at a position closer to the photosensitive member 31 than the spring mounting portion 71*a* of the separation claw base 71 in the thickness direction of the sheet conveyed in the direction indicated by the arrow U. A contact portion of the leading edge 72*c* that contacts the photosensitive member 31 is located at a position farther from the photosensitive member 31 than the rotating shaft 72*b* in the thickness direction of the sheet conveyed in the direction indicated by the arrow U. With such a positional relationship, the spring 73 urges the separation claw 72 so that the leading edge 72*c* of the separation claw 72 comes into contact with the surface of the photosensitive member 31.

In this manner, the leading edge 72*c* of the separation claw 72 is urged by the spring 73 so that the leading edge 72*c* is constantly in contact with the photosensitive member 31. The spring 73 is an example of an urging member.

Here, the urging force of the spring 73 is set to about 0.5 gf to prevent the surface of the photosensitive member 31 from being damaged by the leading edge 72*c*. The rotation moment of the rotating photosensitive member 31 weakens the force for the leading edge 72*c* of the separation claw 72 to contact the photosensitive member 31 to about 0.05 gf. Accordingly, even when the separation claw 72 is constantly in contact with the photosensitive member 31, the photosensitive member 31 is less likely to be damaged.

Figure 6A:
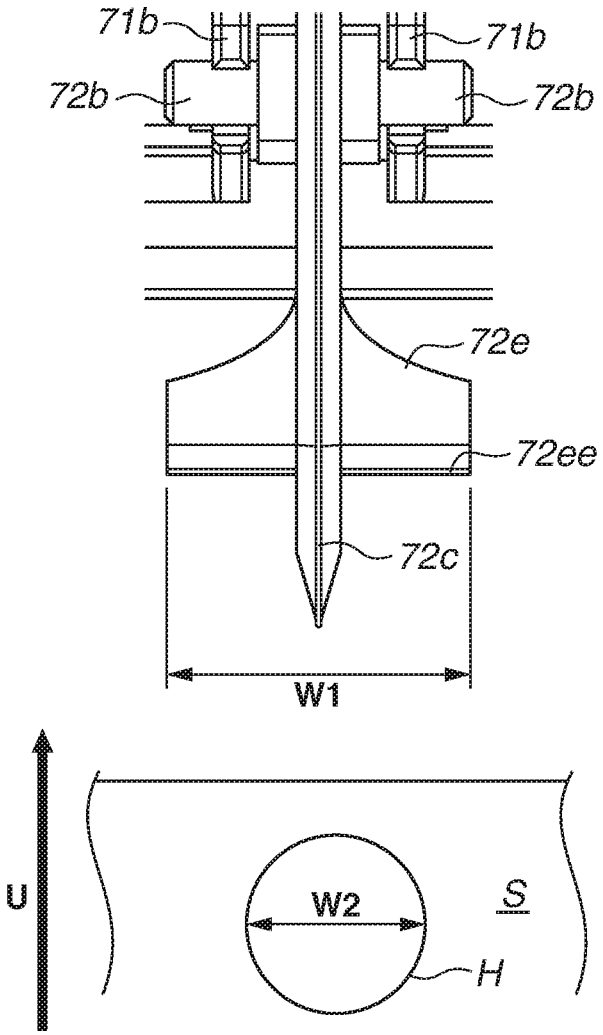
FIGS. 6A and 6B are enlarged views each illustrating a separation claw according to the first exemplary embodiment.
Figure 6B:
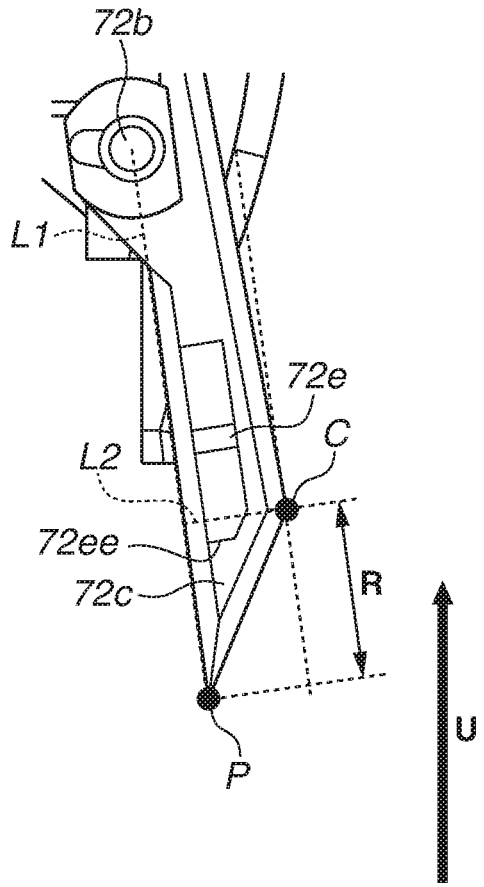

Next, the function of the side surface ribs 72*e* will be described with reference to FIGS. 6A and 6B. FIGS. 6A and 6B are enlarged views each illustrating the separation claw 72 according to the first exemplary embodiment. FIG. 6A illustrates the separation claw 72 as viewed along the sheet thickness direction. FIG. 6B is a side view illustrating the vicinity of the side surface rib 72*e* of the separation claw 72.

In a case where the separation claw 72 includes a sharp leading edge 72*c*, in a case where a sheet S, such as pre-punched paper, which has a hole H formed thereon in advance by a punching process, is conveyed, the leading edge 72*c* may get into the hole H. Such an issue may occur if the leading edge of the sheet sticking to an image bearing member, such as the photosensitive member 31, cannot be separated from the photosensitive member 31 by the separation claw 72.

In the case of removing the sheet S wound around the photosensitive member 31 in a state where the leading edge 72*c* of the separation claw 72 gets into the hole H of the sheet S, the separation claw 72 is rotated by the sheet being pulling out. In such a case, if the separation claw 72 deeply gets into the hole H of the punched sheet S, the leading edge 72*c* cannot be pulled out from the hole H even when the separation claw 72 is rotated in pulling out the sheet, and the separation claw 72 is rotated beyond the rotatable area of the separation claw 72, so that the separation claw 72 may be damaged.

Accordingly, in the present exemplary embodiment, the side surface ribs 72*e* are provided to prevent the leading edge 72*c* from deeply getting into the hole H of the punched sheet S. In other words, the providing of the side surface ribs 72*e* prevents the leading edge 72*c* from getting into the hole H of the sheet S to a position where the leading edge 72*c* cannot be pulled out from the hole H of the punched sheet S even when the separation claw 72 is rotated. The side surface rib 72*e* is an example of a protruding portion that protrudes from the leading edge 72*c* of the separation claw 72 in the rotation axis direction of the photosensitive member 31.

As illustrated in FIGS. 6A and 6B, a width W1 of the pair of the side surface ribs 72*e* in the rotation axis direction of the photosensitive member 31, which is orthogonal to the sheet conveyance direction (direction indicated by the arrow U), is set to be greater than the diameter W2 of a general punched hole.

Standard diameters of holes formed by a puncher or the like, or holes formed on loose-leaf paper are defined within a range of <Φ6.0±0.5 mm. Specifically, a diameter W2 illustrated in FIG. 6A generally falls within the range of 6.0±0.5 mm. Accordingly, in the present exemplary embodiment, the width W1 is set to be greater than 6.5 mm. With this structure, even in the case of conveying the punched sheet S, the punched sheet S cannot slip through the side surface ribs 72*e*.

As illustrated in FIG. 6B, assuming that a point farthest from the photosensitive member 31 on a perpendicular L2 to a straight line L1 connecting a most leading edge P (tip portion) of the leading edge 72*c* of the separation claw 72 and the rotation center of the rotating shaft 72*b* is regarded as an apex C of the leading edge 72*c*, a lower end 72*ee* of each side surface rib 72*e* is provided in an area R between the apex C and the most leading edge P in the direction toward the leading edge of the separation claw 72. In the present exemplary embodiment, the lower end 72*ee* of each side surface rib 72*e* is located at a position within a range of 5.0 mm from the most leading edge P.

With this structure, the side surface ribs 72*e* come into contact with the punched sheet S before the leading edge 72*c* deeply gets into the hole H of the punched sheet S. Specifically, the contact between the side surface ribs 72*e* and the punched sheet S enables the leading edge 72*c* to be prevented from deeply getting into the hole H. In other words, the contact between the side surface ribs 72*e* and the punched sheet S enables the leading edge 72*c* to be prevented from getting into the hole H of the punched sheet S to a position where the leading edge 72*c* cannot be pulled out from the hole H of the punched sheet S even when the separation claw 72 is rotated.

Thus, even if the leading edge of the punched sheet S is attracted and stuck to the surface of the photosensitive member 31 and cannot be separated by the leading edge 72*c* of the separation claw 72, this structure prevents the leading edge 72*c* from getting into the hole H to a position where the leading edge 72*c* cannot be pulled out from the hole H of the punched sheet S even when the separation claw 72 is rotated. Consequently, it is possible to prevent the separation claw 72 from being damaged while the punched sheet S sticking to the surface of the photosensitive member 31 is being removed.

The position at which each side surface rib 72*e* is provided relative to the leading edge 72*c* is not limited to the position illustrated in FIG. 6B, as long as each lower end 72*ee* is provided within the area R between the most leading edge P and the apex C of the leading edge 72*c*. For example, the side surface rib 72*e* may be provided such that each lower end 72*ee* is located at a position closer to the most leading edge P than the position illustrated in FIG. 6B.

In the exemplary embodiment described above, the side surface rib 72*e* is provided on both side surfaces of the separation claw 72 in the rotation axis direction of the photosensitive member 31, but instead the side surface rib 72*e* may be provided on only one side of the separation claw 72. In such a structure, the length between the leading edge 72*c* of the separation claw 72 and the side surface rib 72*e* of the separation claw 72 in the rotation axis direction of the photosensitive member 31 is set to be equal to the width W1 described above, thus preventing the leading edge 72*c* from getting into the hole H of the sheet S to a position where the leading edge 72*c* cannot be pulled out from the hole H of the punched sheet S even when the separation claw 72 is rotated.

In the exemplary embodiment described above, the width W1 is set to be greater than 6.5 mm, thus preventing the leading edge 72*c* from deeply getting into the hole H of the punched sheet S. However, the width W1 is not limited to the above-described size. For example, the width W1 may be set to be smaller the above described size in the case of conveying a punched sheet including a hole with a diameter smaller than the standard size.

A second exemplary embodiment of the present disclosure will be described below. The first exemplary embodiment described above illustrates an example of the shape of the separation claw 72. Components of the present exemplary embodiment are similar to those of the first exemplary embodiment, except for the shape of the side surface ribs 72*e* of the first exemplary embodiment. Accordingly, the same components are denoted by the same reference numerals and descriptions thereof are omitted.

Figure 7:
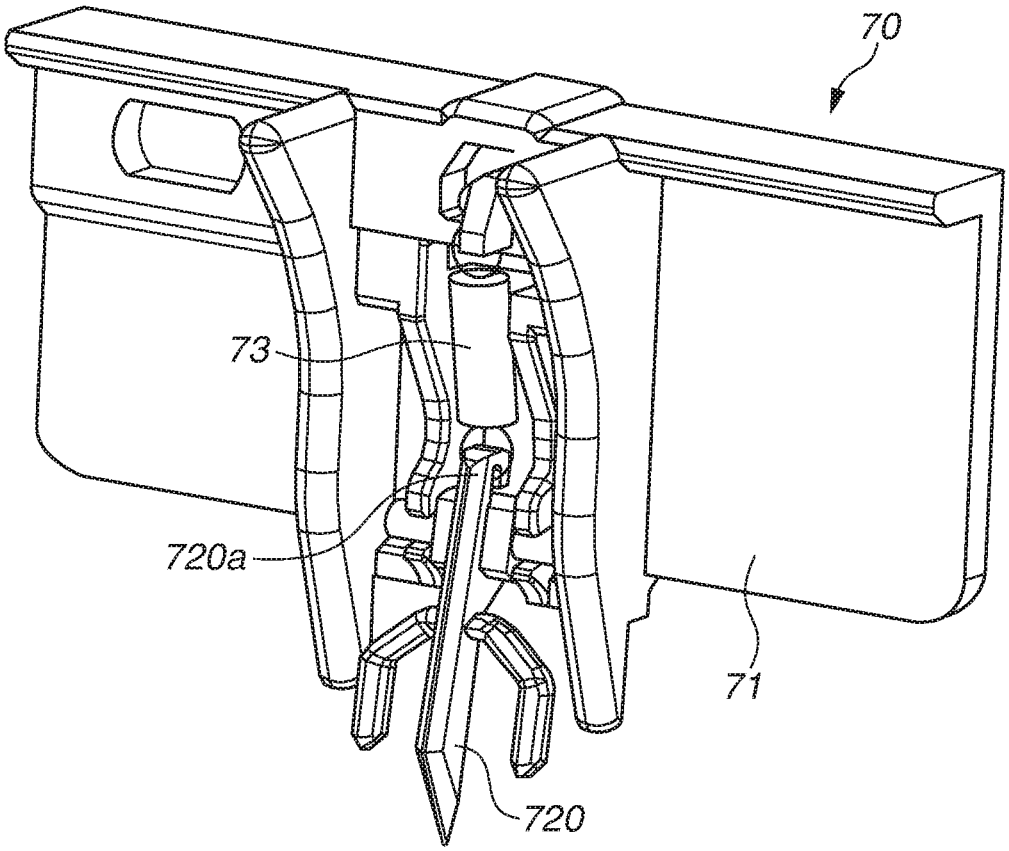
FIG. 7 is a perspective view illustrating a separation mechanism according to a second exemplary embodiment.
Figure 8A:
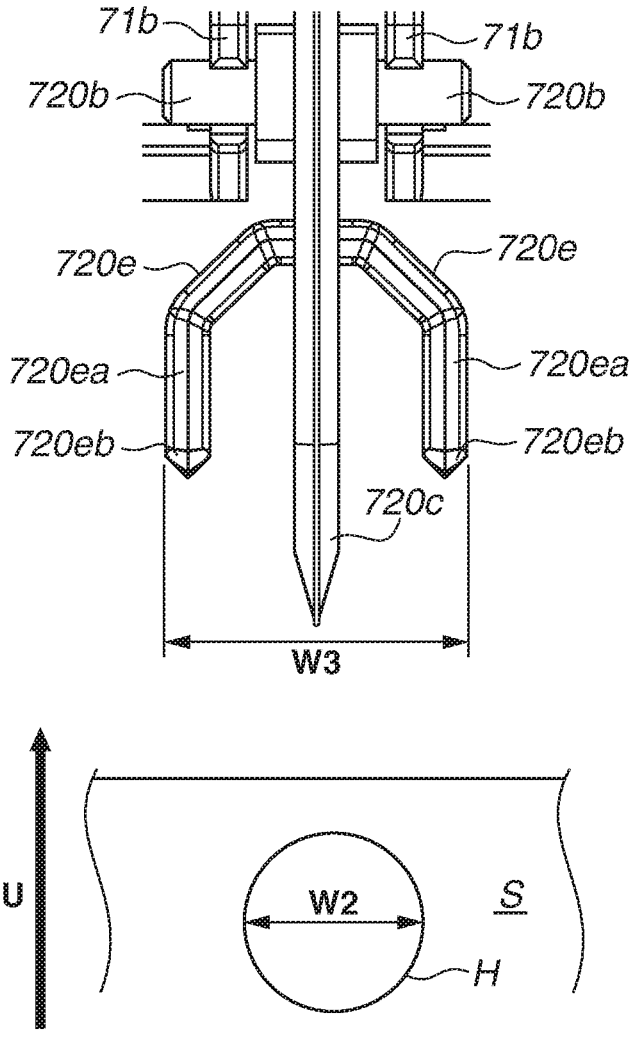
FIGS. 8A and 8B are enlarged views each illustrating a separation claw according to the second exemplary embodiment.
Figure 8B:
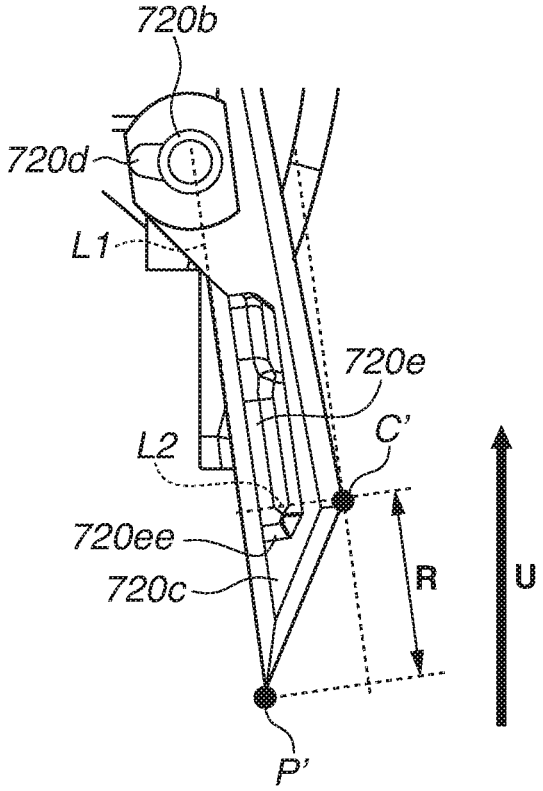

FIG. 7 is a perspective view illustrating the separation mechanism 70 according to the second exemplary embodiment. FIGS. 8A and 8B are enlarged views each illustrating a separation claw 720 according to the second exemplary embodiment. FIG. 8A is a front view of the separation claw 720. FIG. 8B is a side view of the separation claw 720.

In the separation mechanism 70 according to the present embodiment, the structures of the separation claw base 71 and the spring 73 are similar to those of the first exemplary embodiment. Thus, the same components are denoted by the same reference numerals and descriptions thereof are omitted. Positional relationships, such as the angle of the separation claw 720 with respect to the photosensitive member 31, are the same as those of the first exemplary embodiment, and thus descriptions thereof are omitted.

The separation claw 720 includes a spring mounting portion 720*a*, a rotating shaft 720*b*, a leading edge 720*c*, a stopper 720*d*, and side surface ribs 720*e* (described below). To the spring mounting portion 720*a*, the claw mounting portion 73*b* of the spring 73 described above is mounted by engaging with the spring mounting portion 720*a*. The rotating shaft 720*b* is rotatably supported by the shaft support portions 71*b* of the separation claw base 71. The leading edge 720*c* comes into contact with the photosensitive member 31 and separates the sheet sticking to the photosensitive member 31. The stopper 720*d* defines the rotation range of the separation claw 72. The side surface ribs 720*e* is an example of a protruding portion that protrudes from the leading edge 720*c* of the separation claw 720 in the rotation axis direction of the photosensitive member 31.

As illustrated in FIG. 8A, the separation claw 720 according to the present exemplary embodiment includes the side surface ribs 720*e*. Each side surface rib 720*e* according to the present exemplary embodiment includes a pair of extension portions 720*ea* extending along an extension direction of the leading edge 720*c* (sheet conveyance direction indicated by the arrow U), and lower ends 720*eb*, each of which is a most leading edge of the corresponding extension portion 720*ea*.

A width W3 which corresponds to a distance between lower ends 720*ee* of the pair of side surface ribs 720*e* in the rotation axis direction of the photosensitive member 31 that is orthogonal to the sheet conveyance direction (direction indicated by the arrow U) is set to be greater than the diameter W2 of a general punched hole.

As described above, standard diameters of holes formed by a puncher or the like, or holes formed on loose-leaf paper are defined within the range of Φ6.0±0.5 mm. Specifically, the diameter W2 illustrated in FIG. 8A generally falls within the range of 6.0±0.5 mm. Accordingly, in the present exemplary embodiment, the width W3 is set to be greater than 6.5. With this structure, even in the case of conveying the punched sheet S, the punched sheet S cannot slip through the side surface ribs 720*e*.

As illustrated in FIG. 8B, assuming that a point farthest from the photosensitive member 31 on the perpendicular L2 to the straight line L1 connecting the rotation center of the rotating shaft 720*b* and a most leading edge P' of the leading edge 720*c* of the separation claw 720 is regarded as an apex C' of the leading edge 720*c*, the lower end 720*eb* of each side surface rib 720*e* is provided in the area R between the apex C' and the most leading edge P' in the direction toward the leading edge of the separation claw 72. In the present exemplary embodiment, the lower end 720*eb* is located at a position within a range of 5.0 mm from the most leading edge P'.

With this structure, the lower ends 720*eb* of the pair of side surface ribs 720*e* contact the punched sheet S before the leading edge 720*c* deeply gets into the hole H of the punched sheet S. More specifically, the contact between the side surface ribs 720*e* and the punched sheet S makes it possible to prevent the leading edge 720*c* from deeply getting into the hole H. In other words, the contact between the side surface ribs 720*e* and the punched sheet S makes it possible to prevent the leading edge 720*c* from getting into the hole H of the punched sheet S to a position where the leading edge 720*c* cannot be pulled out from the hole H of the punched sheet S even when the separation claw 720 is rotated.

Thus, also in the structure according to the second exemplary embodiment, even in a case where the leading edge of the punched sheet S is attracted and stuck to the photosensitive member 31 and cannot be separated by the leading edge 720*c* of the separation claw 720, the leading edge 720*c* is prevented from getting into the hole H of the sheet S to a position where the leading edge 720*c* cannot be pulled out from the hole H of the sheet S even when the separation claw 720 is rotated. Accordingly, it is possible to prevent the separation claw 720 from being damaged while the punched sheet S sticking to the photosensitive member 31 is being removed.

The position at which each side surface rib 720*e* is provided relative to the separation claw 720 is not limited to the position illustrated in FIG. 8B, as long as each lower end 720*eb* is provided within the area R between the apex C' of the leading edge 720*c* and the most leading edge P'. For example, the side surface ribs 720*e* may be provided such that each lower end 720*eb* is located at a position closer to the most leading edge P' than the position illustrated in FIG. 8B.

In the exemplary embodiment described above, the side surface rib 720*e* is provided on both side surfaces of the separation claw 720 in the rotation axis direction of the photosensitive member 31, but instead the side surface rib 720*e* may be provided only on one side of the separation claw 720. In such a structure, the length between the leading edge 720*c* of the separation claw 720 and the side surface rib 720*e* of the separation claw 720 in the rotation axis direction of the photosensitive member 31 is set to be equal to the width W1 described above, thus preventing the leading edge 720*c* from getting into the hole H of the punched sheet S to a position where the leading edge 720*c* cannot be pulled out from the hole H of the punched sheet S even when the separation claw 720 is rotated.

In the exemplary embodiment described above, the width W1 is set to be greater than 6.5 mm to thereby prevent the leading edge 720*c* from getting into the hole H of the punched sheet S. However, the width W1 is not limited to the above-described size. For example, the width W1 may be set to be smaller than the above-described size in the case of conveying a punched sheet including a hole with a diameter smaller than the standard size.

Other Exemplary Embodiment

The exemplary embodiments described above illustrate the photosensitive member 31 as an example of the image bearing member. However, if the image forming apparatus 1 is configured to form an image on a sheet with toner of a plurality of colors, i.e., Y, M, C, and K, the exemplary embodiments can be applied to an intermediate transfer belt having the following structure. That is, a toner image is transferred at a primary transfer position from photosensitive members (a first photosensitive member and a second photosensitive member) for respective colors, and the intermediate transfer belt transfers superimposed toner images onto a sheet at a secondary transfer position. In such a structure, a separation mechanism may be provided on the downstream side of the secondary transfer position to prevent the sheet from being attracted and stuck to the intermediate transfer belt. In this case, the provision of the separation mechanism as described above in the exemplary embodiments also enables the leading edge of the separation claw to be prevented from getting into the hole of the punched sheet that cannot be separated. With this structure, the separation claw 720 can be prevented from being damaged while the punched sheet S is being removed.

According to an aspect of the present disclosure, it is possible to prevent the separation claw from getting into a hole of a punched sheet to a position where the separation claw cannot be pulled out from the hole of the punched sheet even in a case where the separation claw is rotated when the punched sheet is pulled out.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2019-090270, filed May 11, 2019, which is hereby incorporated by reference herein in its entirety.

What is claimed is:

1. An image forming apparatus comprising:

an image bearing member configured to bear a toner image and transfer the toner image onto a sheet at a transfer position;

a cleaning mechanism configured to clean toner on the image bearing member; and a separation mechanism disposed between the transfer position and the cleaning mechanism in a rotation direction of the image bearing member, the separation mechanism including a separation claw configured to come into contact with the image bearing member and separate the sheet, and a support base that rotatably supports the separation claw, wherein the separation claw extends towards the image bearing member from the support base, and includes a leading edge that comes into contact with a surface of the image bearing member and a protruding portion, protruding in a rotation axis direction of the image bearing member, wherein an apex of the separation claw is disposed at a position farthest from the surface of the image bearing member in a direction perpendicular to a straight line connecting a tip portion of the leading edge and a rotation center of a shaft portion of the separation claw engaged with the support base, and wherein the protruding portion is disposed at a position between the tip portion and the apex.

2. The image forming apparatus according to claim 1, further comprising an urging member between the support base and the separation claw and configured to urge the leading edge of the separation claw against the surface of the image bearing member.

3. The image forming apparatus according to claim 1, wherein the protruding portion is provided on both sides of the separation claw in the rotation axis direction of the image bearing member.

4. The image forming apparatus according to claim 1, wherein the protruding portion includes an extension portion extending in an extension direction of the leading edge of the separation claw.

5. The image forming apparatus according to claim 3, wherein a length of the extension portions in the rotation axis direction of the image bearing member is greater than 6.5 mm.

6. The image forming apparatus according to claim 1, wherein a length between the protruding portion and the leading edge in the rotation axis direction of the image bearing member is greater than 6.5 mm.

7. The image forming apparatus according to claim 1, further comprising:

a charging unit configured to charge the image bearing member;

an exposure unit configured to scan the image bearing member with laser light to form an electrostatic latent image on the image bearing member, the image bearing member being charged by the charging unit; and a development unit configured to develop, with toner, the electrostatic latent image formed on the image bearing member.

8. The image forming apparatus according to claim 1, further comprising:

a first photosensitive member;

a second photosensitive member;

a first charging unit configured to charge the first photosensitive member;

a second charging unit configured to charge the second photosensitive member;

an exposure unit configured to scan the first photosensitive member and the second photosensitive member with laser light to form an electrostatic latent image on each of the first photosensitive member and the second photosensitive member;

a first development unit configured to develop the electrostatic latent image formed on the first photosensitive member with toner; and a second development unit configured to develop the electrostatic latent image formed on the second photosensitive member with toner of a color different from a color of the toner used by the first development unit, wherein the image bearing member is an intermediate transfer belt onto which a toner image formed on the first photosensitive member and a toner image formed on the second photosensitive member are transferred.

* * * * *